US007735954B2

(12) United States Patent
Xu et al.

(10) Patent No.: US 7,735,954 B2
(45) Date of Patent: Jun. 15, 2010

(54) PRINTING SYSTEM PARTICLE REMOVAL DEVICE AND METHOD

(75) Inventors: Jinquan Xu, Rochester, NY (US); Zhanjun Gao, Rochester, NY (US); James Mazzarella, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 614 days.

(21) Appl. No.: 11/682,352

(22) Filed: Mar. 6, 2007

(65) Prior Publication Data

US 2008/0218552 A1 Sep. 11, 2008

(51) Int. Cl.
*B41J 2/165* (2006.01)

(52) U.S. Cl. ..... 347/27

(58) Field of Classification Search ..... 347/68–72, 347/84, 85, 27
See application file for complete search history.

(56) References Cited

U.S. PATENT DOCUMENTS 5,543,827 A 8/1996 VanSteenkiste et al.
6,242,846 B1 6/2001 Ashizawa et al.
6,724,607 B2 4/2004 Hayashi et al.
6,776,467 B2 * 8/2004 Yamazaki et al. ..... 347/7
6,812,618 B2 11/2004 Hayashi
6,964,470 B2 11/2005 Kagami
7,150,512 B2 12/2006 Levin et al.
7,216,962 B2 * 5/2007 Miyazawa et al. ..... 347/68

* cited by examiner

*Primary Examiner*—An H Do
(74) *Attorney, Agent, or Firm*—William R. Zimmerli

(57) ABSTRACT

A printing system includes a source of liquid including a liquid outlet. The source of liquid includes a liquid with particles. A liquid vibrating mechanism is operably associated with the source of liquid. A controller is operably associated with the liquid vibrating mechanism. The controller is configured to control a desired direction of movement of the particles of the liquid by causing the liquid vibrating mechanism to vibrate the liquid with a non-symmetric energy such that movement of the particles is biased in the desired direction.

22 Claims, 10 Drawing Sheets

PRINTING SYSTEM PARTICLE REMOVAL DEVICE AND METHOD

FIELD OF THE INVENTION

The present invention relates, generally, to the removal of particles from liquid and, in particular, to the removal of particles from liquids used in printing systems.

BACKGROUND OF THE INVENTION

Ink jet printing has become recognized as a prominent contender in the digitally controlled, electronic printing arena because of, e.g., its non-impact, low noise characteristics and system simplicity. For these reasons, ink jet printers have achieved commercial success for home and office use and other areas.

Traditionally, digitally controlled inkjet printing capability is accomplished by one of two technologies. Both technologies feed ink through channels formed in a printhead. Each channel includes a nozzle from which droplets of ink are selectively extruded and deposited upon a medium.

The first technology, commonly referred to as "drop-on-demand" ink jet printing, provides ink droplets for impact upon a recording surface using a pressurization actuator (thermal, piezoelectric, etc.). Selective activation of the actuator causes the formation and ejection of a flying ink droplet that crosses the space between the printhead and the print media and strikes the print media. The formation of printed images is achieved by controlling the individual formation of ink droplets, as is required to create the desired image. Typically, a slight negative pressure within each channel keeps the ink from inadvertently escaping through the nozzle, and also forms a slightly concave meniscus at the nozzle, thus helping to keep the nozzle clean.

Conventional "drop-on-demand" ink jet printers utilize a pressurization actuator to produce the ink jet droplet at orifices of a print head. Typically, one of two types of actuators is used including heat actuators and piezoelectric actuators. With heat actuators, a heater, placed at a convenient location, heats the ink causing a quantity of ink to phase change into a gaseous steam bubble that raises the internal ink pressure sufficiently for an ink droplet to be expelled. With piezoelectric actuators, an electric field is applied to a piezoelectric material possessing properties that create a mechanical stress in the material causing an ink droplet to be expelled. The most commonly produced piezoelectric materials are ceramics, such as lead zirconate titanate, barium titanate, lead titanate, and lead metaniobate.

The second technology, commonly referred to as "continuous stream" or "continuous" ink jet printing, uses a pressurized ink source which produces a continuous stream of ink droplets. Conventional continuous ink jet printers utilize electrostatic charging devices that are placed close to the point where a filament of working fluid breaks into individual ink droplets. The ink droplets are electrically charged and then directed to an appropriate location by deflection electrodes having a large potential difference. When no print is desired, the ink droplets are deflected into an ink capturing mechanism (catcher, interceptor, gutter, etc.) and either recycled or disposed of. When a print is desired, the ink droplets are not deflected and allowed to strike a print media. Alternatively, deflected ink droplets may be allowed to strike the print media, while non-deflected ink droplets are collected in the ink capturing mechanism.

Regardless of the type of inkjet printer technology, it is desirable to keep the ink free of particles that may clog or partially clog the printhead nozzles. In inkjet printing, some micro-sized solid particles present in printing ink. These solid particles may come from dry ink in the system, or conglomeration of sub-micron ink pigments. There are also evidences of growth of bacteria that form particles in the ink. In other cases the origins of these solid particles are unknown. For the particles, which sizes are in microns, comparable to the nozzle size, may not pass through nozzles smoothly, causing droplet deflection that adversely affects droplet placement. The particles even can block the nozzles that end in printhead early replacement. The problem is known as a nozzle contamination issue in inkjet printing. To eliminate the contamination issue, a method to produce ultra clean ink is called for. Another problem related to particle contamination is that once a printhead is contaminated by the particles, it has to be dismounted and sent to manufacturer for refurbishing, which is expensive in both finance cost and production time.

It is important to point out that even though filters are commonly used in inkjet printhead to remove particles, they are not effective at removing in-situ particles that are formed near the printhead nozzles as dried ink or conglomerations of small particles. These in-situ particles tend to form within the printhead near the nozzles when the printhead is not in service. Furthermore, efforts of removing these particles by recycling the ink through the ink tank with filters are not fully successful since some particles are trapped in the areas where the flow field is dominated by local circulation near the nozzles. In the printing mode, however, these particles may randomly stray away from the local circulation and reach the nozzle, causing nozzle contamination. This issue is particularly severe for continuous inkjet printing where a large amount of ink is normally consumed during a printing operation.

U.S. Pat. No. 7,150,512 discloses a device using a solvent based cleaning fluid to flush the nozzle, drop generator and catcher while the continuous ink jet printing device is not in print mode. The reclaimed ink from the catcher has less debris therefore the recycling rate to deliver the ink is increased due to a lower concentration of debris being present in the reclaimed ink thereby minimizing clogging of the components.

U.S. Pat. No. 6,964,470 discloses a method to prevent adhesion of colorant particles to the tip of an ink guide (or nozzle). When in cleaning mode a piezoelectric device vibrates the ink guide, thereby giving the colorant particles kinetic energy to eject from the surface.

U.S. Pat. No. 5,543,827 discloses an ink jet printhead nozzle when in cleaning mode a piezoelectric device vibrates the nozzle plate to facilitate cleaning solvent to flow in the same direction as gravity. A controller operates not only the valve to allow cleaning fluid to flow but also controls the nozzle plate vibration.

These techniques are not always effective especially when trying to remove particles that are trapped in areas where the fluid flow field is dominated by local circulation, for example, near the nozzle of a printhead. Therefore, it would be useful to have an apparatus and method capable of removing these particles.

SUMMARY OF THE INVENTION

According to another aspect of the present invention, a method of operating a printing system includes providing a source of liquid including a liquid outlet, the source of liquid including a liquid, the liquid including particles; providing a liquid vibrating mechanism operably associated with the source of liquid; and using the liquid vibrating mechanism to control a desired direction of movement of the particles of the liquid by vibrating the liquid with a non-symmetric energy such that movement of the particles is biased in the desired direction.

According to another aspect of the present invention, a printing system includes a source of liquid including a liquid outlet. The source of liquid includes a liquid with particles. A liquid vibrating mechanism is operably associated with the source of liquid. A controller is operably associated with the liquid vibrating mechanism. The controller is configured to control a desired direction of movement of the particles of the liquid by causing the liquid vibrating mechanism to vibrate the liquid with a non-symmetric energy such that movement of the particles is biased in the desired direction.

BRIEF DESCRIPTION OF THE DRAWINGS

In the detailed description of the example embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1B:
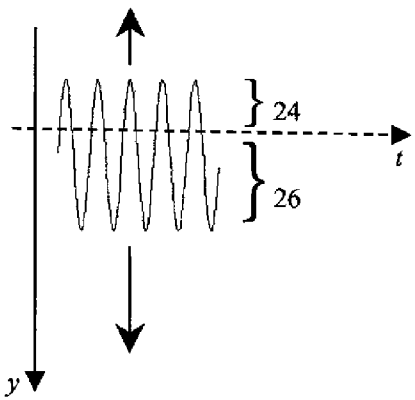
FIGS. 1A and 1B show a schematic two-dimensional view of a printing system including a liquid vibrating mechanism.
Figure 1A:
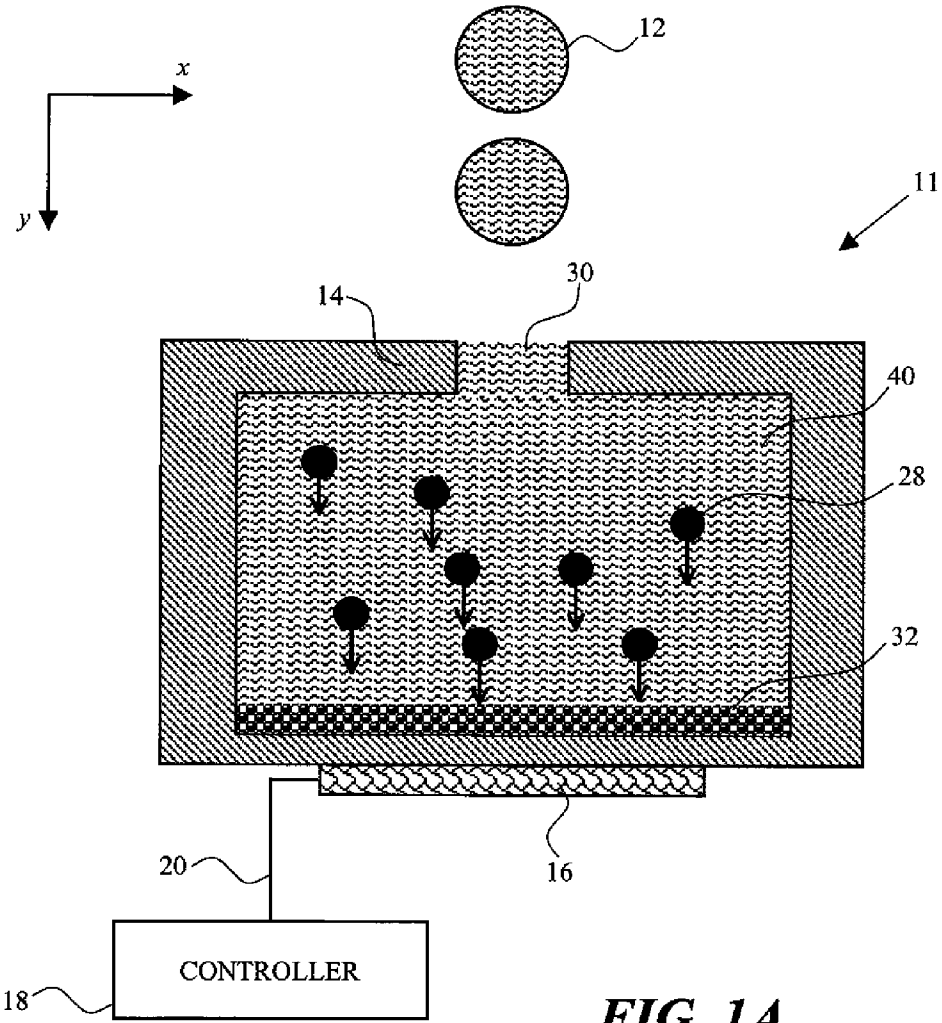

Referring to FIG. 1A, an inkjet printhead 11 is shown ejecting liquid droplets 12 through a nozzle plate 14 onto a selected location on a receiver (not shown). The liquid droplets 12 generally comprise a recording agent, such as a dye or pigment, and a large amount of solvent. The solvent, or carrier liquid, typically is made up of water, an organic material such as a monohydric alcohol, a polyhydric alcohol or mixtures thereof. The nozzle plate 14 is representative of nozzle plates made by any of several common commercially used methods and may be composed of any of several materials, for example, electroplated nickel or gold.

As shown in FIG. 1A, an actuator 16 is attached to printhead 11. Actuator 16 is operable to vibrate printhead 11 such that particles 28 are caused to move in the y-direction away from nozzle 30. The actuator 16 may be, for example, a well known commercially available actuator such as a magnetic actuator or a piezoelectric actuator.

The actuator 16 is connected in electrical communication with and is electrically controlled by a controller 18 over a conductive path 20. In FIG. 1B, the amplitude of movement 24 in the negative y-direction created by actuator 16 is smaller than the amplitude of movement 26 in the positive y-direction created by actuator 16. When operating in this manner, particles 28 will move away from the nozzle 30, as shown in FIG. 1A, reducing the likelihood of nozzle 30 becoming contaminated by particles 28 collecting in or about nozzle 30.

A particle collection mechanism 32 is optionally placed in the printhead 11 away from the nozzle 30. The particle collection mechanism may compose of porous material that traps particles.

In operation, a vibrating mechanism (actuator 16) is operably associated with the source of liquid 40 (e.g. ink). Using a controller, actuator 16 is used to control a desired direction of movement of the particles 28 in the liquid 40 by vibrating the liquid with a non-symmetric energy such that movement of the solid particles is biased in desired direction, which is a direction away from the ink outlet of the source of ink.

Using the ink vibrating mechanism to control the desired direction of movement of the particles 28 may occur during at least one of startup, maintenance, and operation (printing) of the printing system 11. During maintenance of the printing system, the desired direction can be in a direction toward the ink nozzle (outlet) 30 of the source of ink 40 in order to flush the particle(s) out of the system. Alternatively, the desired direction can be in a direction away from the ink nozzle 30 of the source of ink. During a startup of the printing system 11, the desired direction can be in a direction toward the ink nozzle 30 of the source of ink to flush the particle out, or in a direction away from the ink nozzle 30 of the source of ink. The direction away from the ink nozzle can also be a direction toward the particle collection mechanism 32 in order to trap the particle. During printing, the desired direction is typically in a direction away from the ink nozzle 30 of the source of ink and/or toward the particle collection mechanism 32 to trap the particle.

For a particle in ink with a non-symmetric energy vibration, the particle moves toward the direction with higher vibration energy. The non-symmetric energy vibration may be realized in several different embodiments, namely, in non-symmetric vibration amplitudes, in non-symmetric vibration velocities, non-symmetric durations and its combinations. The vibration can be in any form, as long as its energy in two vibrating directions is non-symmetric. However, from a practical point of view, the vibration can be relative easily implemented in a periodic waveform.

Although the embodiment described above and the embodiments described below are described in context with printing systems, the present invention is not intended to be limited to printing systems. The present invention is applicable to other types of liquid sources where removing of particles contained in the liquid is needed or desired.

For inkjet printing, the liquid source can be a printhead and the liquid outlet can be a nozzle. If the outlet is a nozzle, the particles typically have a size that is substantially comparable to the size of the nozzle. In the discussion below, the terms "liquid" and "ink" can be used interchangeably.

Figure 2:
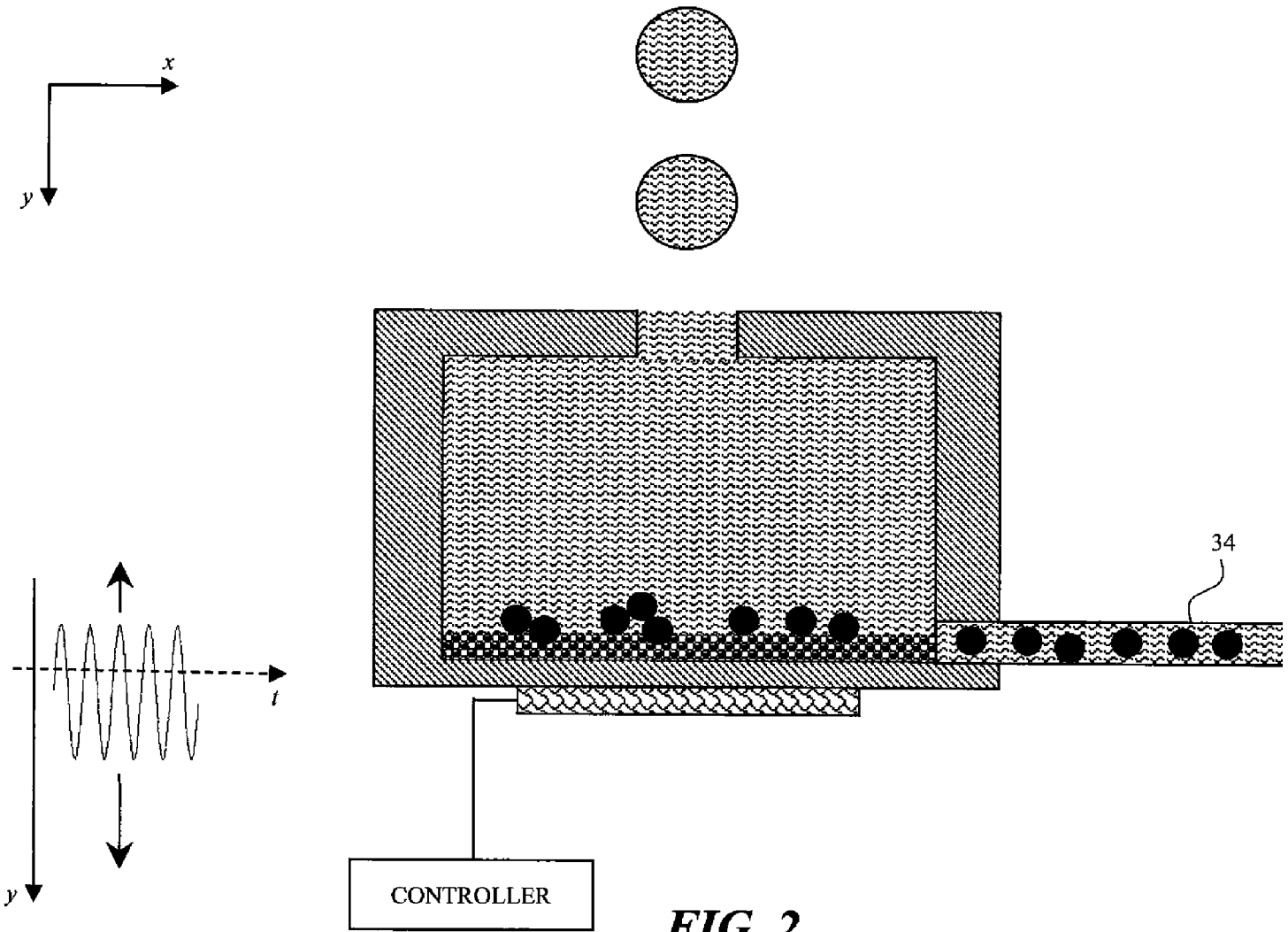
FIG. 2 shows a schematic view of a different embodiment with a vibration actuator and a liquid recycling path.

Another example embodiment is shown in FIG. 2. In FIG. 2, the example embodiment of FIG. 1 includes a liquid recycling system 34 which is used to remove the particles that have been caused to move away from the nozzle of the printhead. Particle collection mechanism 32 can be optionally included in the embodiment shown in FIG. 2.

The liquid recycling system 34 may include a filter or filters appropriately sized to trap the particles and thus facilitate their removal prior to the liquid being returned for use in the printing system. The liquid recycling system 34 may include a vacuum source that provides a vacuum that is sufficient to cause the particles to be moved from the printhead into the recycling system 34. In this sense, liquid recycling system 34 is similar to recycling systems known in continuous inkjet printing technology. When equipped with vacuum, liquid recycling system 34 may be actuated to remove collected particles during a printhead maintenance cycle.

Figure 3:
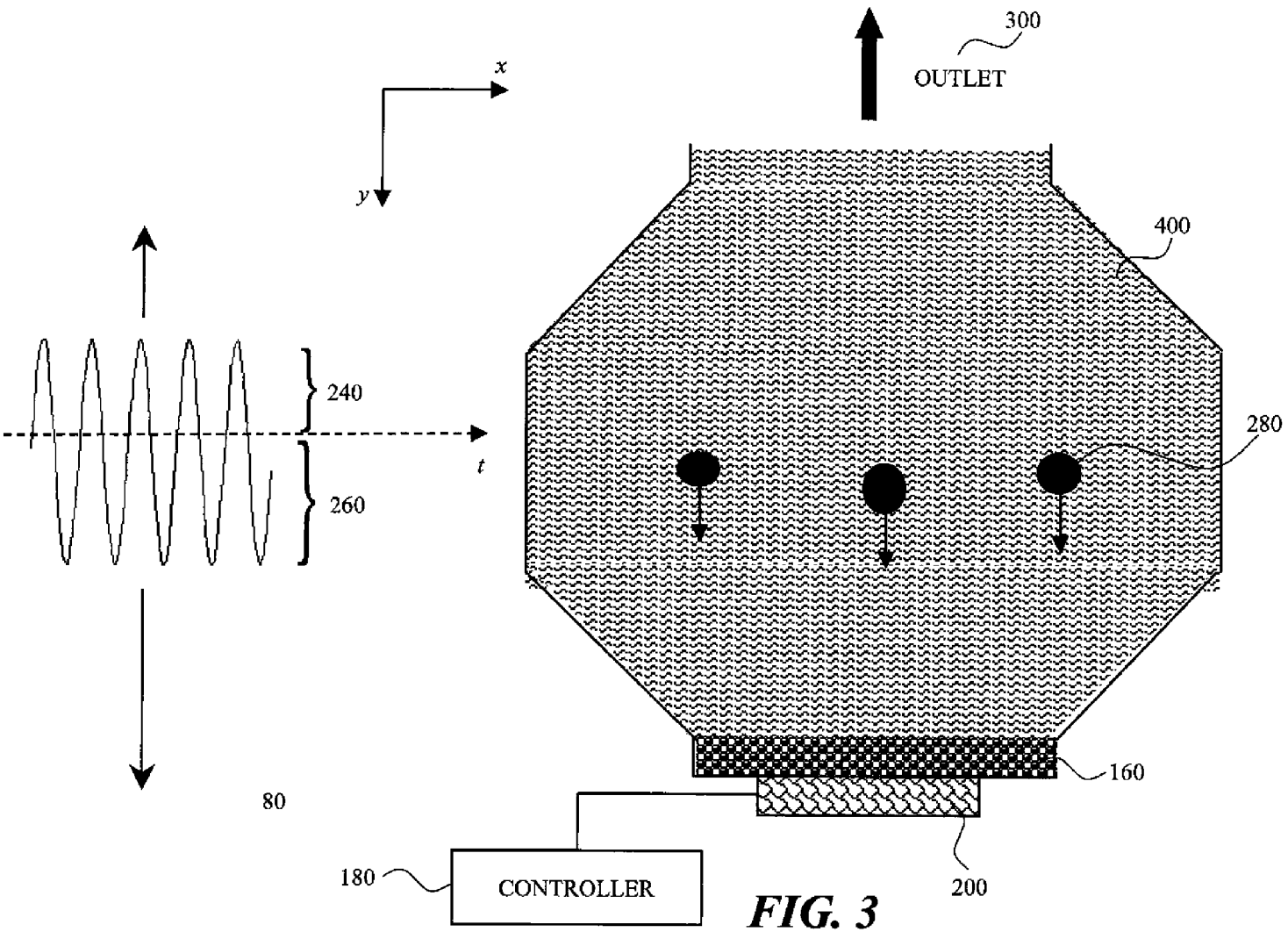
FIG. 3 shows a schematic two-dimensional view of a liquid source with a vibration actuator.

FIG. 3 shows another example embodiment of the present invention. In FIG. 3, a liquid source 400, for example, a tank that supplies liquid (e.g. ink) to a printhead includes a liquid vibrating mechanism 200 affixed thereto. Liquid vibrating mechanism functions like the liquid vibrating mechanism 16 described above. A particle collection mechanism 160 is positioned in liquid source 400 to collect particles 280 as the particles 280 move away from an outlet 300 of the liquid source 400. The outlet 300 is connected to another portion of the system, for example, a printhead, to provide ink for printing.

The vibrating mechanism 200 is operably associated with the source of liquid 400 and controls a desired direction of movement of the particles 280 in the liquid 400 by vibrating the liquid with a non-symmetric energy such that movement of the particles is biased in the desired direction, which is a direction away from the liquid outlet 300 of the source of ink. Other interpretations of the device shown in FIG. 3 include other types of devices that provide liquids other than inkjet inks to the printing system.

Figure 4:
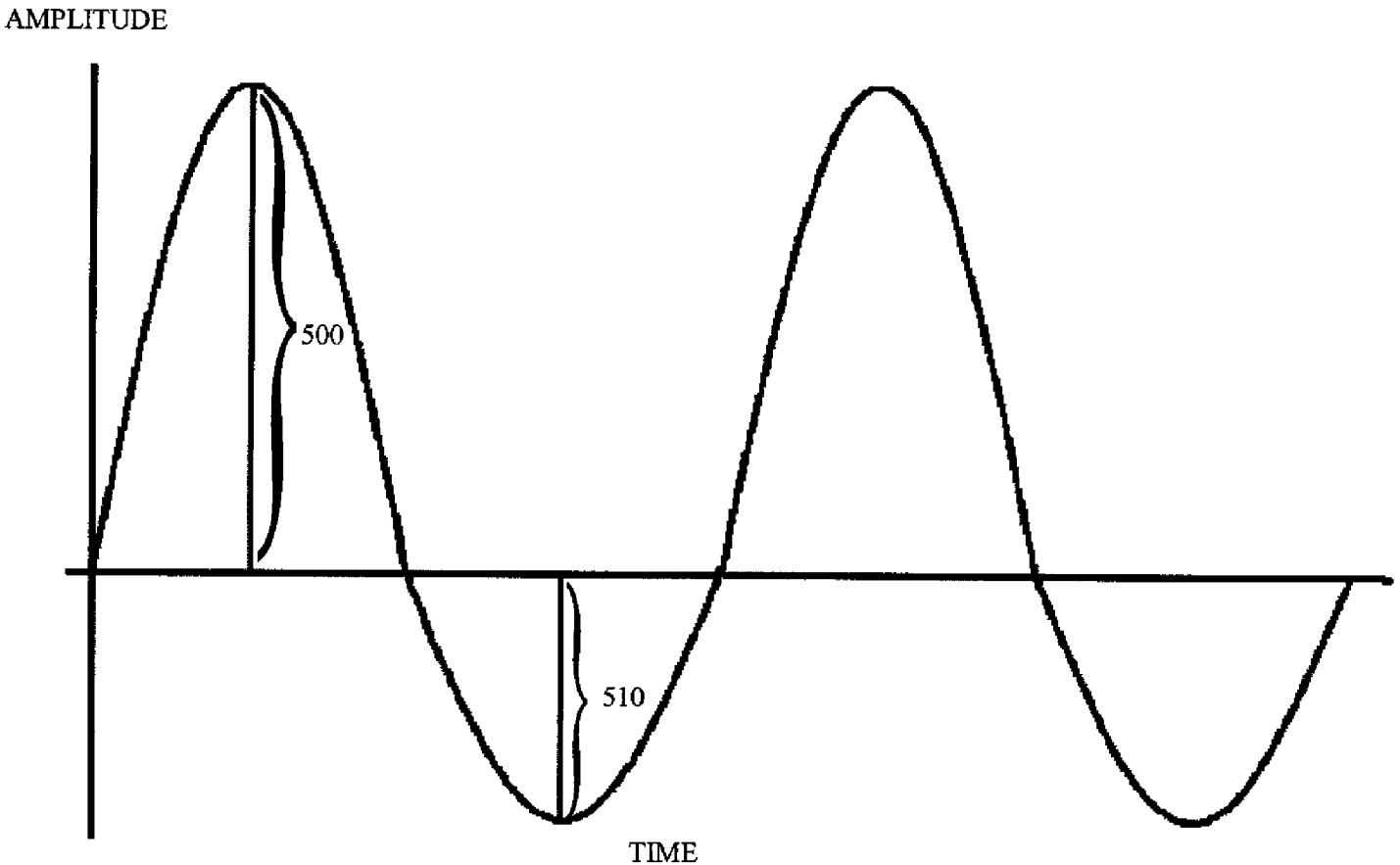
FIG. 4 shows a non-symmetric energy waveform vibration implemented in non-symmetric amplitudes.

FIG. 4 shows a non-symmetric energy waveform vibration implemented in non-symmetric amplitudes for actuator 16 in FIG. 1, actuator 200 in FIG. 3. Vibrating the liquid with the non-symmetric amplitudes waveform such that the movement of the solid particles is biased in the desired direction. In the waveform shown in FIG. 4, the upward movement amplitude 500 is larger than the downward movement amplitude 510. Therefore, the particle moves up, toward the direction in which the amplitude is larger.

Figure 5:
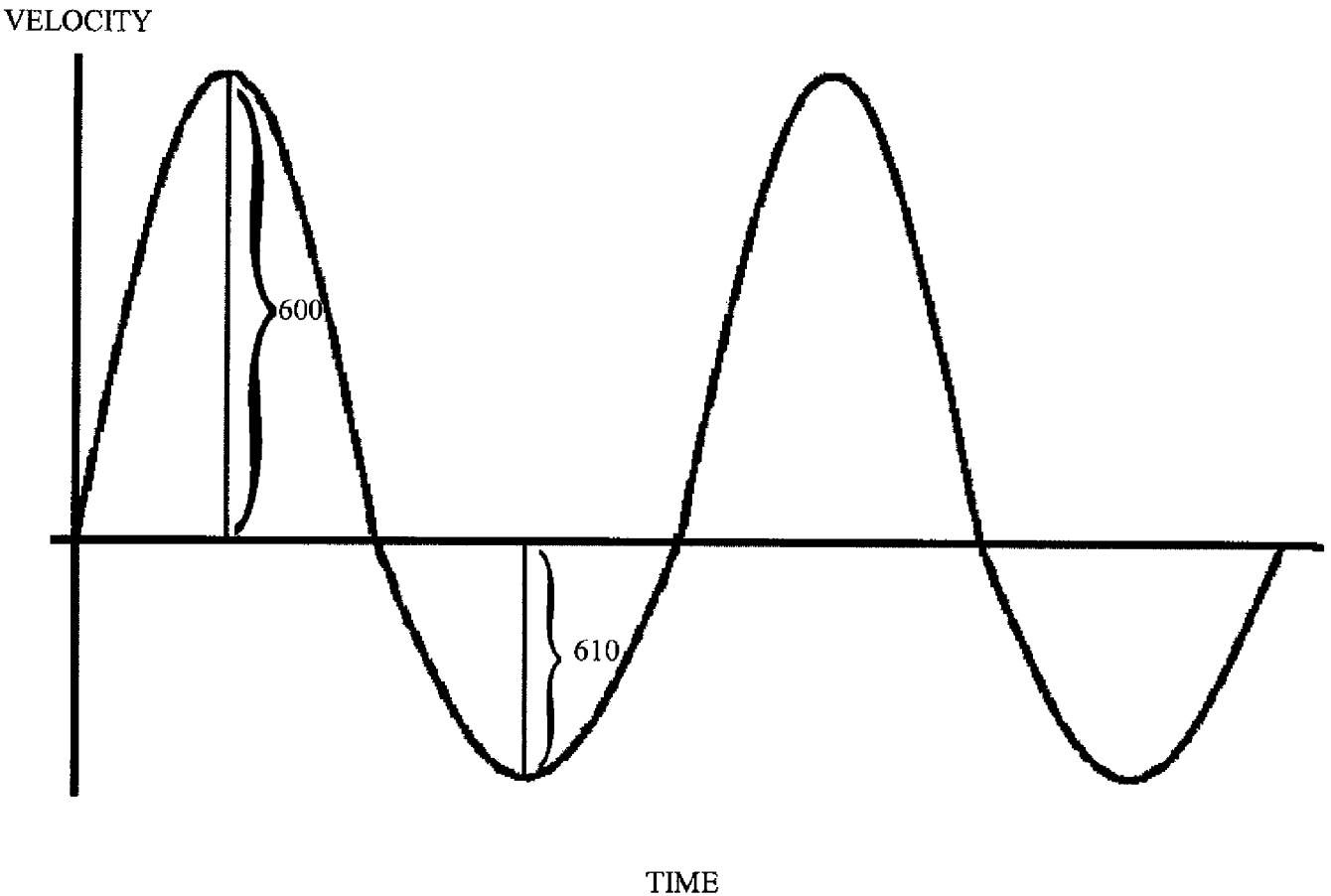
FIG. 5 shows a non-symmetric energy waveform vibration implemented in non-symmetric velocities.

FIG. 5 shows a non-symmetric energy waveform vibration implemented in non-symmetric velocities. Vibrating the liquid with a non-symmetric energy such that the movement of the solid particles is biased in the desired direction includes vibrating the liquid with a period waveform having non-symmetric velocities sufficient to move the solid particles in the desired direction. In the waveform shown in FIG. 5, the maximum magnitude of the upward movement velocity 600 is higher than the maximum magnitude of the downward movement velocity 610. The particle moves upward.

Figure 6:
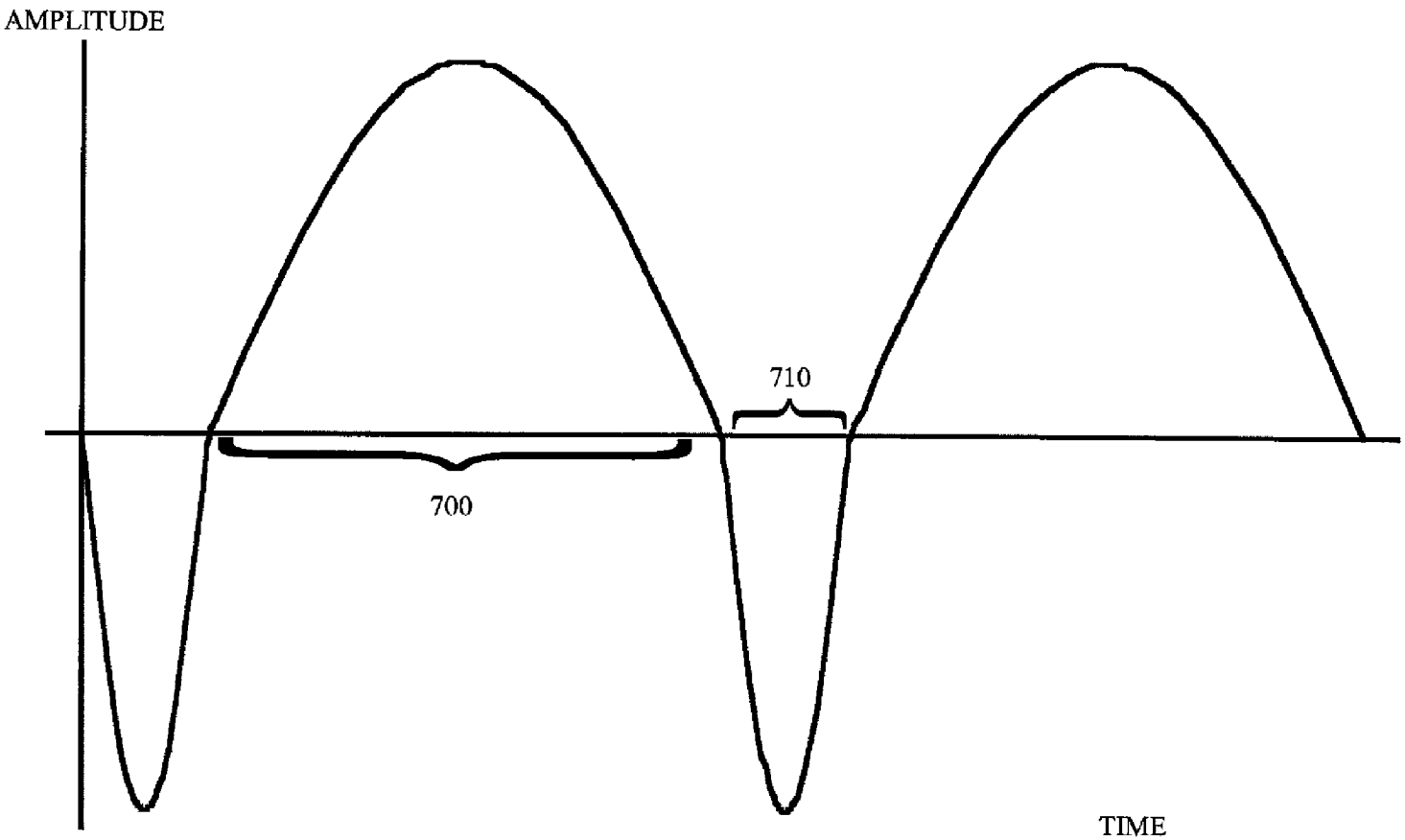
FIG. 6 shows a non-symmetric energy waveform vibration implemented in non-symmetric durations.

FIG. 6 shows a non-symmetric energy waveform vibration implemented in non-symmetric durations. Vibrating the liquid with a non-symmetric energy such that movement of the solid particles is biased in the directed direction includes vibrating the liquid with a periodic waveform having non-symmetric durations. In the waveform shown in FIG. 6, the duration 700 of the particle moving upward is longer than that duration 710 of the particle moving downward. The particle moves toward the direction in which the duration is longer.

Certainly, the individual components of the non-symmetry can be combined to achieve a non-symmetric energy. For example, in yet another embodiment, vibrating the liquid with a non-symmetric energy such that movement of the solid particles is biased in the directed direction includes vibrating the liquid with a periodic waveform having non-symmetric durations and amplitudes.

Figure 7:
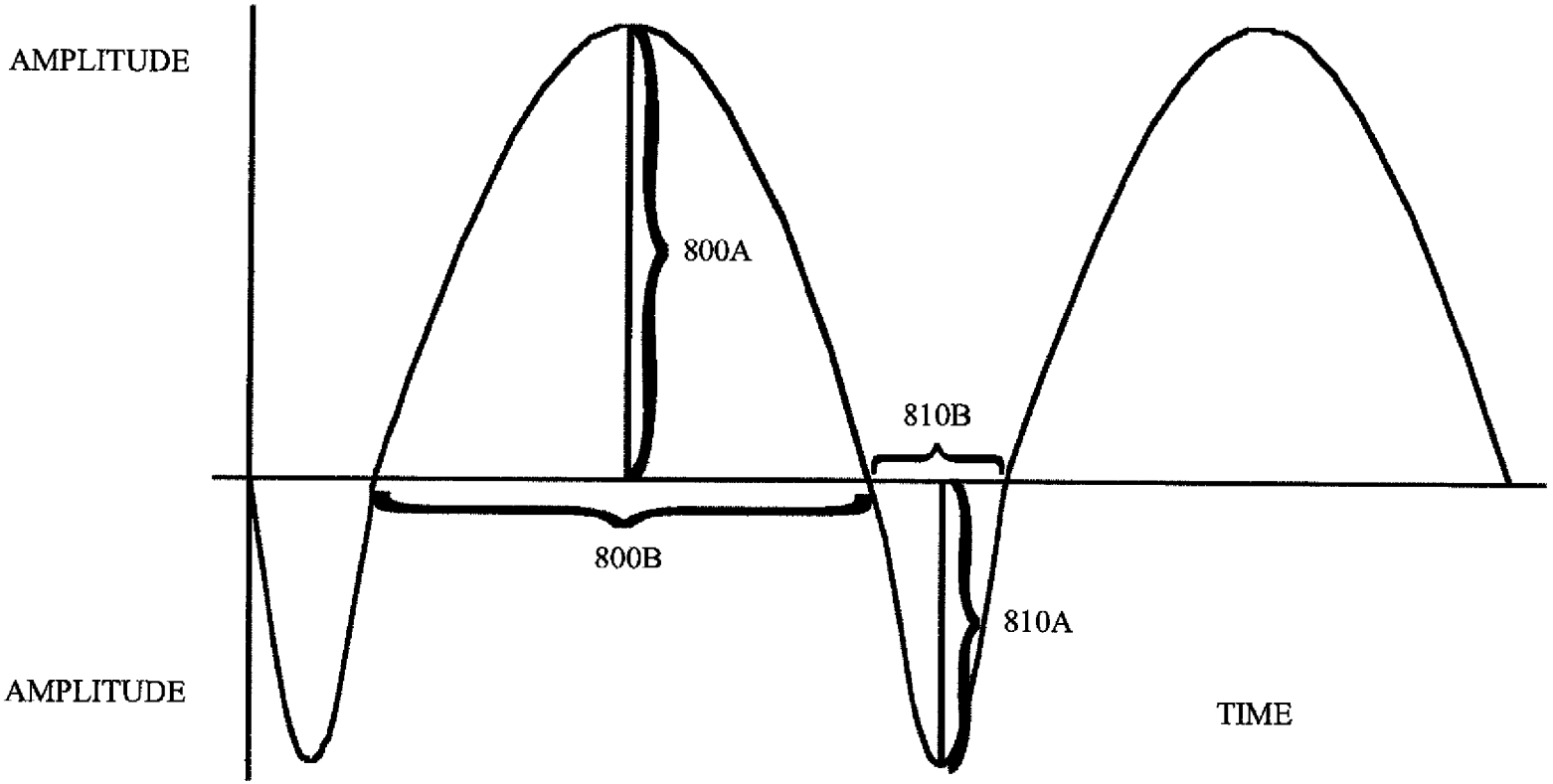
FIG. 7 shows a non-symmetric energy waveform vibration implemented in non-symmetric amplitude and durations.

In the waveform shown in FIG. 7, the upward movement amplitude 800A is larger than the downward movement amplitude 810A, the duration 800B of the particle moving upward is longer than that duration 810B of the particle moving downward. The particle moves toward the direction in which the duration is longer and the amplitude is higher. In general, the particle moves toward the direction in which energy is higher.

Figure 8:
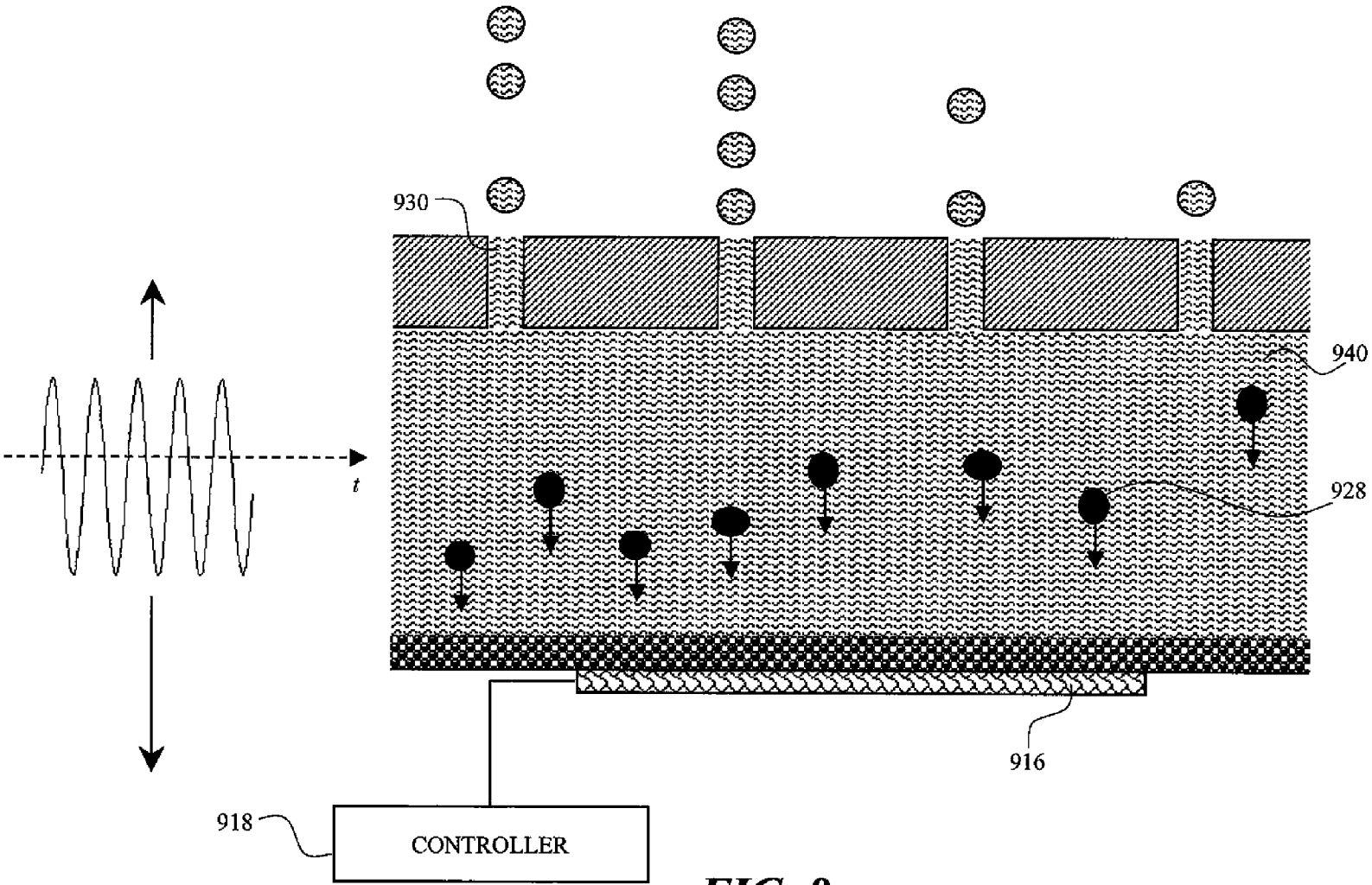
FIG. 8 shows a schematic two-dimensional view of a printing system with a vibration actuator and multi-nozzles.

FIG. 8 shows a printing system comprising a source of liquid including a liquid outlet 930, the source of liquid including a liquid 940, the liquid including solid particles 928. In the printing system, a liquid vibrating mechanism 916 is operably associated with the source of liquid 940. Also in the printing system, a controller 918 is operably associated with the liquid vibrating mechanism. The controller 918 is configured to control a desired direction of movement of the solid particles 928 of the liquid by causing the liquid vibrating mechanisms 916 to vibrate the liquid with a non-symmetric energy such that the movement of the solid particles is biased in the desired direction. Understandably, the liquid source here is a printhead and liquid outlet is a nozzle. In the embodiment shown in FIG. 8, the vibrating mechanism for particle movement is considered onboard because it is associated with the printhead. However, in other embodiments, see FIG. 3, for example, the vibrating mechanism is considered independent or stand-alone because it is associated with another portion of the printing system.

Figure 9:
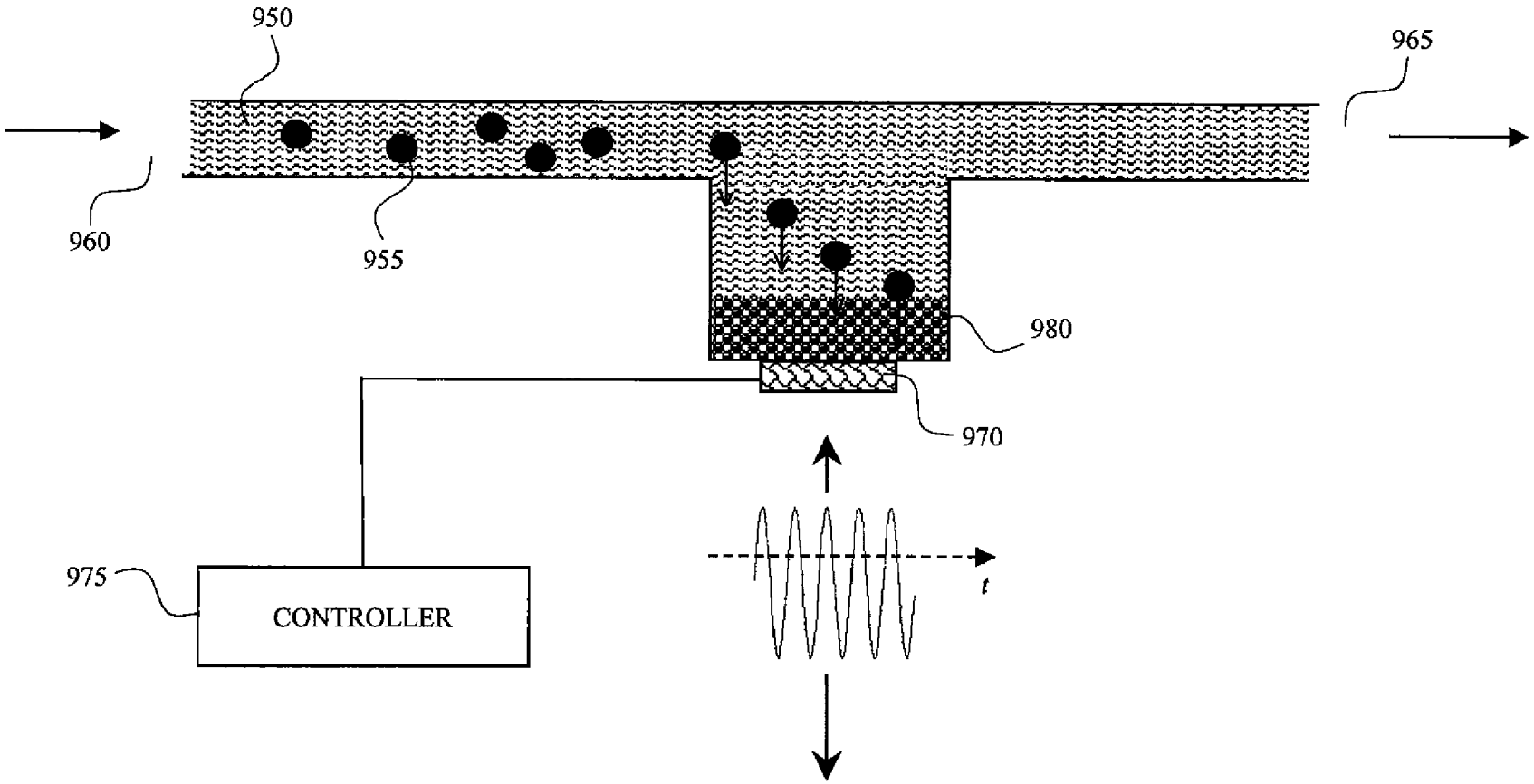
FIG. 9 shows an embodiment of a stand-alone particle cleaning apparatus.

FIG. 9 is another embodiment of a stand-alone particle cleaning apparatus. A source of liquid 950 containing particles 955 is provided through an inlet 960 to outlet 965. A vibration actuator 970 is controlled by a controller 975 to cause the vibration of the liquid bias toward the downward direction so that the particle 955 move toward a particle collection mechanism 980. The particle collection mechanism such as a porous material will retain the particle so that the liquid is free from particles when coming out of the outlet 965. The liquid source 950 can be a liquid supply line that is used to delivery liquid, for example, ink, from a supply tank to a printhead. The liquid source can be provided with a collection area 985 (for example, a portion of the supply line having an enlarged area when compared to other portions of the supply line) that is used to collect the particles caused to move away from the supply line. In this example, the liquid outlet is the outlet 965 of the liquid supply line.

The actuator 16, 200, 916, and 970 in the present invention may be various vibration actuators available commercially. For example, vibration actuators disclosed in U.S. Pat. No. 6,812,618, U.S. Pat. No. 6,724,607, and U.S. Pat. No. 6,242,846 are suitable for use in the present invention. Magnetic actuators and piezoelectric actuators are particularly well suited for use in the present invention.

A magnetic actuator utilizes magnetostrictive materials to convert magnetic energy to mechanical energy and vice versa. As a magnetostrictive material is magnetized, it strains; that is it exhibits a change in length per unit length. Conversely, if an external force produces a strain in a magnetostrictive material, the material's magnetic state will change. This bi-directional coupling between the magnetic and mechanical states of a magnetostrictive material provides a transduction capability that is used for both actuation and sensing devices. Magnetostriction is an inherent material property that will not degrade with time.

In many devices, conversion between electrical and magnetic energies facilitates device use. This is most often accomplished by sending a current through a wire conductor to generate a magnetic field or measuring current induced by a magnetic field in a wire conductor to sense the magnetic field strength. Hence, most magnetostrictive devices are in fact electro-magneto-mechanical transducers.

A piezoelectric actuator works on the principle of piezoelectricity. Piezoelectricity is the ability of crystals and certain ceramic materials to generate a voltage in response to applied mechanical stress. Piezoelectricity was discovered by Pierre Curie. The piezoelectric effect is reversible in that piezoelectric crystals, when subjected to an externally applied voltage, can change shape by a small amount. (For instance, the deformation is about 0.1% of the original dimension in PZT.) The effect finds useful applications such as the production and detection of sound, generation of high voltages, electronic frequency generation, microbalance, and ultra fine focusing of optical assemblies. A break through was made in the 1940's when scientists discovered that barium titanate could be bestowed with piezoelectric properties by exposing it to an electric field.

Piezoelectric materials are used to convert electrical energy to mechanical energy and vice-versa. The precise motion that results when an electric potential is applied to a piezoelectric material is of primordial importance for nanopositioning. Actuators using the piezo effect have been commercially available for 35 years and in that time have transformed the world of precision positioning and motion control. Piezo actuators can perform sub-nanometer moves at high frequencies because they derive their motion from solid-state crystalline effects. They have no rotating or sliding parts to cause friction. Piezo actuators can move high loads, up to several tons. Piezo actuators present capacitive loads and dissipate virtually no power in static operation. Piezo actuators require no maintenance and are not subject to wear because they have no moving parts in the classical sense of the term.

For actuator 16, 200, 916, and 970 in the present invention using piezoelectric material, the poling axis of the material is directed from one electrode to the other. Such a configuration is a thickness mode actuator. When the voltage is applied between the electrodes, the thickness of the piezoelectric will change, resulting a relative displacement of up to 0.2%. Displacement of the piezoelectric actuator is primarily a function of the applied electric field of strength and the length of the actuator, the forced applied to it and the property of the piezoelectric material used. With the reverse field, negative expansion (Contraction) occurs. If both the regular and reverse fields are used, a relative expansion (strain) up to 0.2% is achievable with piezo stack actuators.

Figure 10:
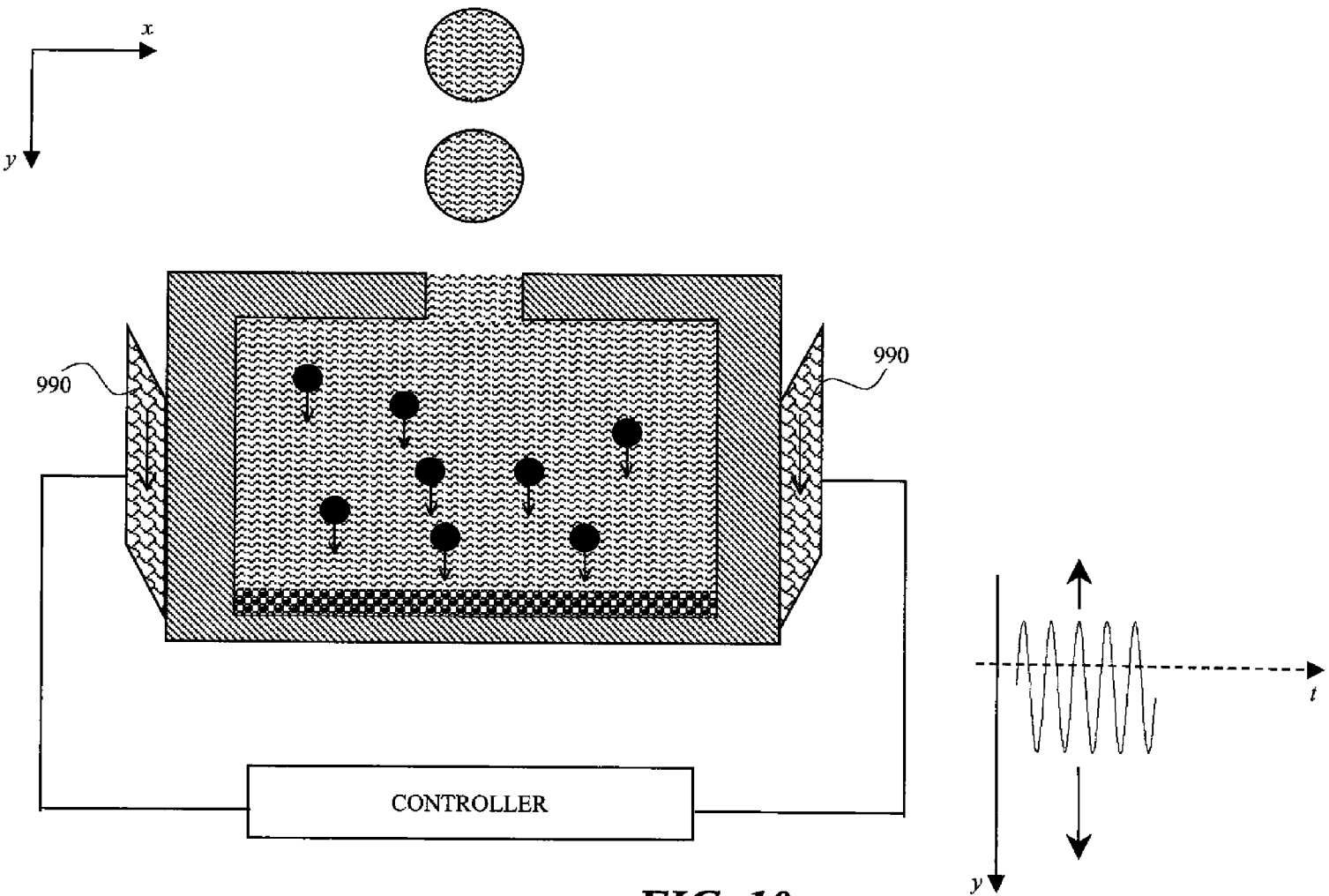
FIG. 10 shows a schematic two-dimensional view of a printing system with a shear mode piezoelectric actuator.

Shear mode piezoelectric actuators can also be used for the present invention. In shear mode piezoelectric actuators, the poling axis of the material is oriented parallel to the plane of the electrodes, not perpendicular as in the thickness mode. When a voltage is applied across the electrodes, shearing forces are produced in the material to cause the material to deform, with the material assuming a parallelogram shape. When such an actuator is driven by an AC voltage, the shearing action produces a vibration in one direction. As the length and width of the piezoelectric are unaffected by the shearing action, the shear mode actuators have no tendency to induce vibrations in other directions. In the example embodiment using a shear mode piezoelectric actuator shown in FIG. 10, a shear mode piezoelectric actuator 990 is utilized, which controls the y-direction vibration of the printhead.

The frequency and amplitude of the actuator for the present invention are selected based on the size and density of the particles and desired speed to remove the particles. In general, a higher frequency and a larger amplitude result in faster particle movement in the desired direction, and thus fast particle removal. A numerical study is completed. In the simulation, a spherical particle of 10 micrometer is seeded in the middle of a water tank. The density of the particle and water are 1050 kg/m3 and 998 kg/m3 (please notice that the density of the particle is larger than that of ink). The water tank vibrates at a frequency of 165,000 Hz. Its vibrating amplitudes are 3 micrometers upward, and 1.5 micrometers downwards. The simulation results show that the particle moves upward as expected.

The invention has been described in detail with particular reference to certain example embodiments thereof, but it will be understood that variations and modifications can be effected within the scope of the invention.

PARTS LIST

11 inkjet printhead
12 ejecting liquid droplets
14 nozzle plate
16 actuator
18 controller
20 conductive path
24 movement
26 movement
28 particles
30 nozzle
32 particle collection mechanism
34 liquid recycling system
40 source of ink
160 particle collection mechanism
200 liquid vibrating mechanism
280 particles
400 liquid source
500 upward movement amplitude
510 downward movement amplitude
600 upward movement velocity
610 downward movement velocity
700 duration
710 duration
800A upward movement amplitude
800B duration
810A downward movement amplitude
810B duration
916 liquid vibrating mechanism
918 controller
928 liquid including solid particles
940 liquid
950 source of liquid
955 containing particles
970 vibration actuator
975 controller
980 particle collection mechanism
985 collection area
990 shear mode piezoelectric actuator

The invention claimed is:

1. A method of operating a printing system comprising:

providing a source of liquid including a liquid outlet, the source of liquid including a liquid, the liquid including particles;

providing a liquid vibrating mechanism operably associated with the source of liquid; and vibrating the liquid to bias movement of the particles in a desired direction by applying a non-symmetric energy to the liquid using the liquid vibrating mechanism.

2. The method of claim 1, wherein the desired direction is a direction away from the liquid outlet of the source of liquid.

3. The method of claim 2, using the liquid vibrating mechanism to control the desired direction of movement of the particles occurs during at least one of a start up, maintenance, and printing of the printing system.

4. The method of claim 1, wherein the desired direction is a direction toward the liquid outlet of the source of liquid and occurs during maintenance of the printing system.

5. The method of claim 4, wherein liquid source is a printhead and liquid outlet is a nozzle.

6. The method of claim 1, the liquid being a pigment having a pigment particle size, the particles having a size, wherein the size of the particles is greater than the particle size of the pigment.

7. The method of claim 1, wherein vibrating the liquid with a non-symmetric energy such that movement of the particles is biased in the desired direction includes vibrating the liquid with a periodic waveform having a non-symmetric amplitude sufficient to move the particles in the desired direction.

8. The method of claim 1, wherein vibrating the liquid with a non-symmetric energy such that movement of the particles is biased in the desired direction includes vibrating the liquid with a periodic waveform having a non-symmetric velocity sufficient to move the particles in the desired direction.

9. The method of claim 1, wherein vibrating the liquid with a non-symmetric energy such that movement of the particles is biased in the desired direction includes vibrating the liquid with a periodic waveform having a non-symmetric duration sufficient to move the particles in the desired direction.

10. The method of claim 1, wherein liquid source is a printhead and liquid outlet is a nozzle.

11. The method of claim 1, wherein the liquid source is a liquid tank, the liquid tank being connected in liquid communication to a printhead.

12. The method of claim 1, the liquid vibrating mechanism being a piezoelectric actuator, wherein vibrating the liquid with a non-symmetric energy such that movement of the particles is biased in the desired direction includes operating the piezoelectric actuator in a shear mode.

13. The method of claim 1, the liquid vibrating mechanism being a piezoelectric actuator, wherein vibrating the liquid with a non-symmetric energy such that movement of the particles is biased in the desired direction includes operating the piezoelectric actuator in a normal mode.

14. The method of claim 1, wherein the non-symmetric energy includes energy applied in a first direction that is greater than energy applied in a second direction.

15. A printing system comprising:

a source of liquid including a liquid outlet, the source of liquid including a liquid, the liquid including particles;

a liquid vibrating mechanism operably associated with the source of liquid; and a controller operably associated with the liquid vibrating mechanism, the controller being configured to cause the liquid vibrating mechanism to vibrate the liquid to bias movement of the particles in a desired direction by applying a non-symmetric energy to the liquid.

16. The system of claim 15, wherein the liquid source is a printhead and liquid outlet is a nozzle.

17. The system of claim 15, wherein the controller is configured to cause the liquid vibrating mechanism to vibrate the liquid with a periodic waveform having a non-symmetric amplitude sufficient to move the particles in the desired direction.

18. The system of claim 15, the liquid vibrating mechanism being a piezoelectric actuator, wherein the controller is configured to operate the piezoelectric actuator in a shear mode.

19. The system of claim 15, the liquid vibrating mechanism being a piezoelectric actuator, wherein the controller is configured to operate the piezoelectric actuator in a normal mode.

20. The system of claim 15, wherein the liquid source is a liquid supply line and the liquid outlet is an outlet of the liquid supply line.

21. The system of claim 15, further comprising:

a liquid recycling system configured to remove the particles from the liquid and return the liquid to the liquid source.

22. The method of claim 14, wherein the second direction is opposite that of the first direction.

* * * * *